United States Patent [19]

Schlunt et al.

[11] Patent Number: 4,669,054

[45] Date of Patent: May 26, 1987

[54] DEVICE AND METHOD FOR OPTICALLY CORRELATING A PAIR OF IMAGES

[75] Inventors: Richard S. Schlunt, Loma Linda; Donald R. Fetterly, Norco, both of Calif.

[73] Assignee: General Dynamics, Pomona Division, Pomona, Calif.

[21] Appl. No.: 730,145

[22] Filed: May 3, 1985

[51] Int. Cl.[4] ..... G06G 9/00

[52] U.S. Cl. ..... 364/822; 364/604; 364/713; 364/728; 364/819; 382/42; 350/162.13

[58] Field of Search ..... 364/807, 819–820, 364/822, 824, 861–862, 713, 715, 728, 602, 604; 382/42; 350/162.12, 162.13

[56] References Cited

U.S. PATENT DOCUMENTS

| | | | |
|---|---|---|---|
| 3,519,331 | 7/1970 | Cutrona et al. | 364/822 |
| 3,599,209 | 8/1971 | Goodrich | 364/822 |
| 3,816,735 | 6/1974 | Bromley | 364/822 X |
| 3,937,942 | 2/1976 | Bromley et al. | 324/77 K |
| 3,942,109 | 3/1976 | Crumly et al. | 324/77 K |
| 3,952,299 | 4/1976 | Hodge et al. | 382/42 X |
| 4,009,380 | 2/1977 | Bocker et al. | 364/713 X |
| 4,016,413 | 4/1977 | Bramley | 324/77 K |
| 4,087,809 | 5/1978 | Fleming | 340/324 R |
| 4,097,749 | 6/1978 | Gardner | 350/162.12 |
| 4,115,801 | 9/1978 | Salmen et al. | 382/42 X |
| 4,123,142 | 10/1978 | Fleming et al. | 350/162.13 |
| 4,139,897 | 2/1979 | Gardner et al. | 324/77 K |
| 4,282,510 | 8/1981 | Southgate | 350/162.14 |
| 4,286,328 | 8/1981 | Bocker | 364/822 |
| 4,389,093 | 6/1983 | Jackson | 364/822 X |
| 4,396,903 | 8/1983 | Habicht et al. | 382/42 X |
| 4,475,238 | 10/1984 | Everhart | 382/42 X |
| 4,505,544 | 3/1985 | Blodgett et al. | 364/822 X |
| 4,514,821 | 4/1985 | Tower | 364/862 |

OTHER PUBLICATIONS

J. Gaffney et al., "Linear Scan Matching", *IBM Technical Disclosure Bulletin,* vol. 10, No. 10, Mar. 1968, pp. 1429–1430.

"Spatial Frequency Analysis With a New Incoherent Optical Approach", by T. W. Cole, *Applied Optics,* 15 May 1980/vol. 19, No. 10, pp. 1665–1669.

"High-Speed Digital Image Processor With Special--Purpose Hardware for Two-Dimensional Convolution", by H. Okuyama and K. Fukui, *Rev. Sci. Instrum.* 50(10), Oct. 1979, pp. 1208–1212.

"Solid State Electroluminescent Display and Scanning Apparatus", by R. J. Lynch, *IBM Technical Disclosure Bulletin,* vol. 9, No. 12, May 1967, pp. 1799–1801.

*Primary Examiner*—Gary V. Harkcom

*Attorney, Agent, or Firm*—Neil F. Martin; Terrance A. Meador; Edward B. Johnson

[57] ABSTRACT

A two-dimensional optical correlation apparatus includes a transmissive optical mask having a transmissivity pattern corresponding to a two-dimensional reference image and an input image buffer that stores a sequence of pixels corresponding to a raster-scanned input image. The input buffer includes a subimage frame corresponding to a particular segment of the raster-scanned format. As the pixels are serially shifted through the image buffer, every subimage in the input image appears at some time in the subimage frame. The subimage frame is connected to an array of optical emitters. As the input image pixels are serially shifted, the emitter array produces a succession of two-dimensional optical signals corresponding to the succession of input image subimages shafted through the subimage frame. The output of the emitter array is projected onto the transparent mask. Light transmitted through the transparent mask from the emitter array is collected on a single photodiode whose output represents the correlation of the reference image and the input image subimage instantaneously stored in the subimage frame.

11 Claims, 7 Drawing Figures

DEVICE AND METHOD FOR OPTICALLY CORRELATING A PAIR OF IMAGES

BACKGROUND OF THE INVENTION

This invention relates to the correlation of a two-dimensional input image with a two-dimensional reference image by illumination of a transmissive mask representing the reference image with an optical signal representing a portion of the input image.

Optical correlation systems are known that utilize a transmissive mask having a transmissivity pattern defining a reference image to be correlated with an image represented by an optical signal projected on the mask. Typically, both the input and reference images are in the form of a rectangular matrix of pixels (picture elements) and correlation is performed by setting up a row or column relationship between the input and reference image pixel arrays and then correlating on a row-by-row or column-by-column basis.

Since correlation in the conventional systems proceeds on a unidimensional basis (i.e. row-by-row or column-by-column) such systems perform only one-dimensional correlation, or two-dimensional correlation built upon the summation of plural one-dimensional correlations.

Clearly, an optical correlator capable of performing real-time, two-dimensional correlation of a pair of images in a single operation would represent an improvement over the prior art optical correlations by reducing the total number of operations presently required for two-dimensional correlation. In view of a reduction in the number of operations, it would be expected that such a device would require a smaller complement of hardware and fewer operational steps than the prior art optical correlators.

SUMMARY OF THE INVENTION

The present invention relates to an electro-optical apparatus for performing two-dimensional optical correlation of a pair of images in real time. The apparatus optically correlates a two-dimensional reference image with a two-dimensional input image capable of being displayed in a raster-scanned format. The input image is provided to the apparatus as a sequence of input signals, such as a series of pixels, that correspond to the input image.

The reference image with which the input image is to be correlated is represented by a pattern of optical transmissivity of an optically transmissive mask.

The sequence of input signals that correspond to the input image are stored, in a two-dimensional format, in an image buffer and sequentially shifted through an image buffer segment, called a subimage frame, corresponding to a predetermined raster segment of the raster-scanned format. Shifting of the sequence through the image buffer causes successive portions of the sequence, each portion corresponding to a respective subimage of the input image, to be successively stored in the subimage frame.

The apparatus further includes an optical image generator responsive to the succession of subimages shifted through the subimage frame for projecting on the reference image mask a succession of optical signals, each of which represents a respective one of the input image subimages.

Light transmitted through the reference image mask by the optical image generator is detected by an optical detector that produces, based upon light transmitted by the projection of an optical signal through the reference image, a correlation signal representative of the degree of correlation between the reference image and the currently-stored subimage.

Since the amount of light transmitted to the detector through the reference image mask as a result of generation of an optical signal will be maximum when the subimage represented by the optical signal corresponds to the reference image, the degree of correlation between the represented subimage and the reference image is directly indicated by the magnitude of the signal produced by the detector.

Therefore it is a principal objective of the present invention to provide an apparatus that performs two-dimensional optical correlation of a pair of two-dimensional images.

It is a further object of the apparatus to perform two-dimensional optical correlation in a single operational step.

These and other objects and attendant advantages of the invention will be fully understood when the following description of a preferred embodiment is read together with the accompanying drawings.

DESCRIPTION OF THE PREFERRED EMBODIMENT

The illustrated embodiment of the present invention which is described in detail hereafter is adapted for two-dimensional optical correlation between a pair of images, one of which is represented by a transmissivity pattern in a transmissive mask. The other image, referred to hereinafter as the input image, is one that can be displayed in a raster-scanned format such as is presented on a conventional TV monitor. The input image, therefore, can be represented by a continuous video signal conventionally formatted for driving a TV monitor. The input image signal can be derived from a variety of sources such as broadcast, videotape, videodisc, or television camera.

The present invention utilizes a novel structure for correlating the input and reference images in real time.

The term "real time" means, for example, that the two-dimensional correlator of the invention is able to perform its function without having to sample and store the input image signal for correlation processing at a time after the input image has changed. The apparatus performs its optical processing without loss of the input image signal and provides an indication of the correlation result virtually simultaneously with a raster-scanned presentation of the image signal by conventional display means.

As is typical, the input image signal is a video signal capable of causing a conventional video display device to produce a visual display of the image in a raster-scanned format made up of 525 parallel lines displayed at 30 frames per second. Typically, in video signal processing each one of the horizontal scan lines produced by the input image signal can be subdivided into plural equal linear segments. Each segment is commonly referred to as a pixel (picture element). Dividing each of the horizontal lines into an equal number of pixels enables one to present the image schematically as a two-dimensional pixel array including M rows (each corresponding to a horizontal line of the raster-scanned format), and N columns, with each column including identically-located pixels in the M lines.

Figure 1:
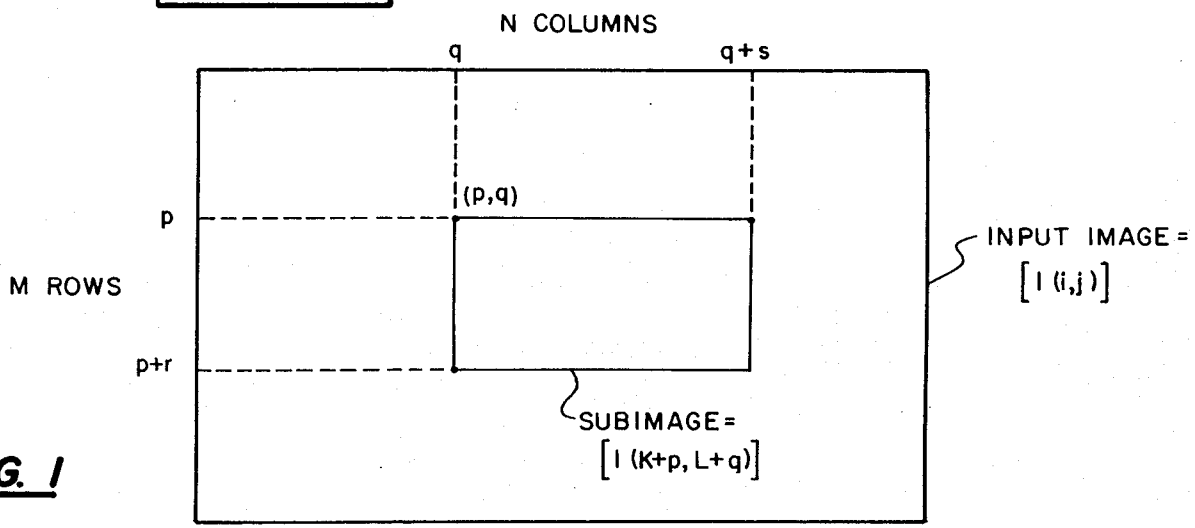
FIG. 1 is a representation of a raster-scanned format for conventionally displaying an image that is to be correlated with a reference image.

This format is schematically illustrated in FIG. 1 and can be described by conventional notation used in linear algebra. In FIG. 1 an input image according to the format is an image composed of a finite number of pixels and is represented by a matrix $[I(i,j)]$ where $1 \leqq i \leqq M$ and $1 \leqq j \leqq N$. The pixel matrix thus represents an input image having M rows with N pixels in each row. A subimage of the image $[I(i,j)]$ can be represented as $[I(K+p, L+q)]$ where $i \leqq K \leqq r-1$ and $j \leqq L \leqq s-1$ and the point (p,q) is fixed. In this case, the subimage consists of r rows with s pixels per row. For the subimage indicated in FIG. 1, r and s are further constrained by $r+p \leqq M+1$ and $s+q \leqq N+1$.

In practice the input image of FIG. 1 can be correlated with a smaller two-dimensional matrix representing a reference image by constraining the size of each subimage of the input image to be equal to the size of the reference image, and by comparing each of the subimages in the input image with the reference image. The process of comparison is called correlation, and can be indicated by a correlation signal having a relatively high magnitude when a particular subimage corresponds to the reference image and a relatively low magnitude when there is no correspondence between a subimage and a reference image.

When there is correlation between the reference image, denoted by $[R(K,L)]$ and a particular subimage $[I(K+P_0,L+q_0)]$, it would be useful to locate the corresponding subimage in the input image. The subimage location can be precisely defined when the point $(p_0,q_0)$ is known.

Figure 2:
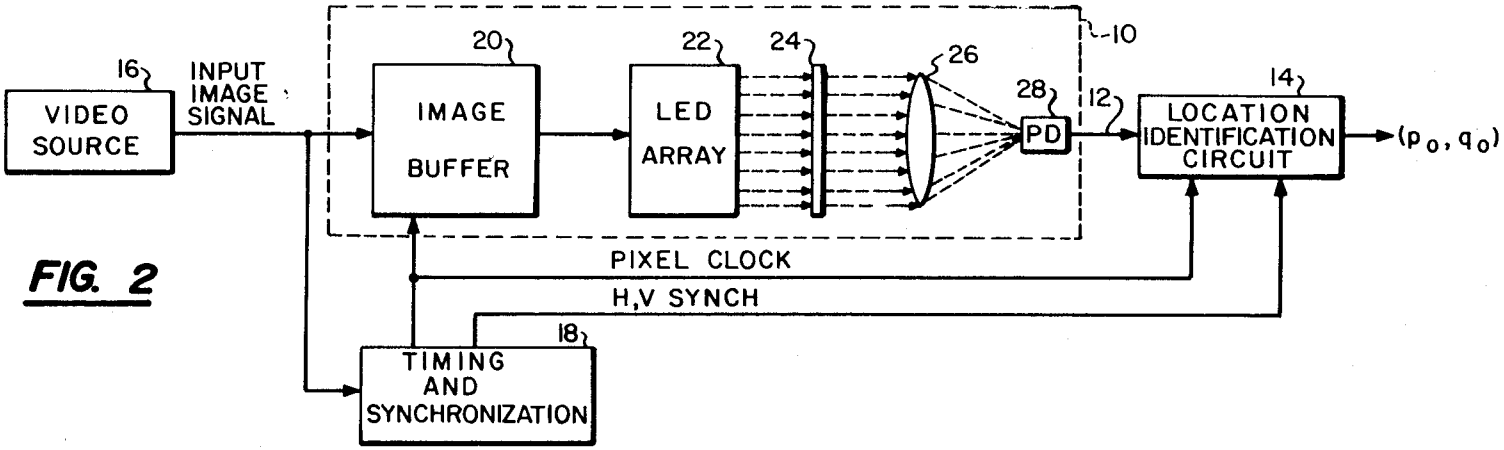
FIG. 2 is a schematic block diagram illustrating the 2-dimensional optical correlator of the invention in a typical operational environment.

In FIG. 2, the two-dimensional optical correlator of the system, indicated by the reference numeral 10, performs the optical correlation and produces a correlation signal on a signal line 12 connected to a location identification circuit 14. The location identification circuit 14 monitors the magnitude of the correlation signal on signal line 12. When the correlation signal is at a maximum, the location identification circuit provides a digital signal identifying the location $(P_0,q_0)$ in the input image matrix that locates a subimage that correlates with the reference image.

The input image signal is provided to the correlator 10 from a conventional video source 16 that can include one of the video sources discussed above. The input image signal has the conventional raster-scanned format described above. The input image signal is fed both to the correlator 10 and to a conventional timing and synchronization circuit 18. Preferably the input image signal will have a conventional composite video format that includes timing and synchronization information to which the timing and synchronization circuit 18 responds. The timing and synchronization circuit 18 can include a typical synch stripper responsive to the input image signal for producing signals (H,V SYNCH) corresponding to the horizontal and vertical synchronization pulses, respectively, that are present on the composite input image signal. The timing and synchronization circuit 18 also includes conventional circuitry for producing a typical pixel clock signal (PIXEL CLOCK) synchronized to the H,V SYNCH signal and oscillating at the frequency of occurrence of the above-described pixels.

The two-dimensional correlator 10 includes an image buffer 20 made up of r analog delay lines, each including N serially-connected storage cells, each for holding a charge corresponding in magnitude to a pixel of the input image. Such a delay line can comprise, for example, a charge-coupled device (CCD) having N storage cells that is clocked by the pixel clock to serially shift pixels through the storage cells at the rate established by the pixel clock. At the end of each field of the composite video signal that forms the input image signal, V SYNCH clears the image buffer 20 to prepare it to receive pixels during the next frame of the input image.

The contents of a particular segment, called a subimage frame, of the image buffer 20 are fed to a light-emitting-diode (LED) array 22. As explained below, the pixel clock causes successive subimages of the input image to be synchronously shifted through the subimage frame where they activate the LED array 22.

Once each pixel clock period, the LED array 22 generates an optical signal including an $r \times s$ array of light signals corresponding to a subimage stored in the subimage frame portion of the buffer 20. Thus, a succession of optical signals corresponding to successive subimages of the input image are generated by the LED array 22.

The succession of optical subimage signals produced by the LED array 22 is directed to a reference image mask 24. The reference image mask 24 includes a transmissive mask with a transmissivity pattern formed on it that corresponds to the reference image $[R(K,L)]$. The pattern preferably consists of an $r \times s$ array of pixels. The mask 24 can include, for example, a photographic mask having the reference image in a positive photographic polarity formed from a pattern of transmissivity that varies according to the reference image.

The succession of optical subimage signals generated by the LED array 22 is directed through the reference mask 24 and results in light being transmitted therethrough. The light transmitted through the mask 24 is collected by a lens 26, which focuses the collected light onto a photodetector 28 that can comprise a photodiode.

Thus, the amount of light transmitted through the reference mask 24 depends upon the correspondence between the optical image generated by the LED array 22 and the reference image on the mask 24. It should be evident that, if the subimage is equivalent to the reference image, a maximum amount of light will be transmitted through the mask, collected by the lens, and focused onto the photodiode 28. The photodetector 28 can include appropriate circuitry to develop an electrical signal whose magnitude varies directly according to the degree of correspondence between the reference image and the subimage currently generated by the LED array 22. This electrical signal forms the correlation signal provided by the optical correlator 10 on the signal line 12.

Figure 3:
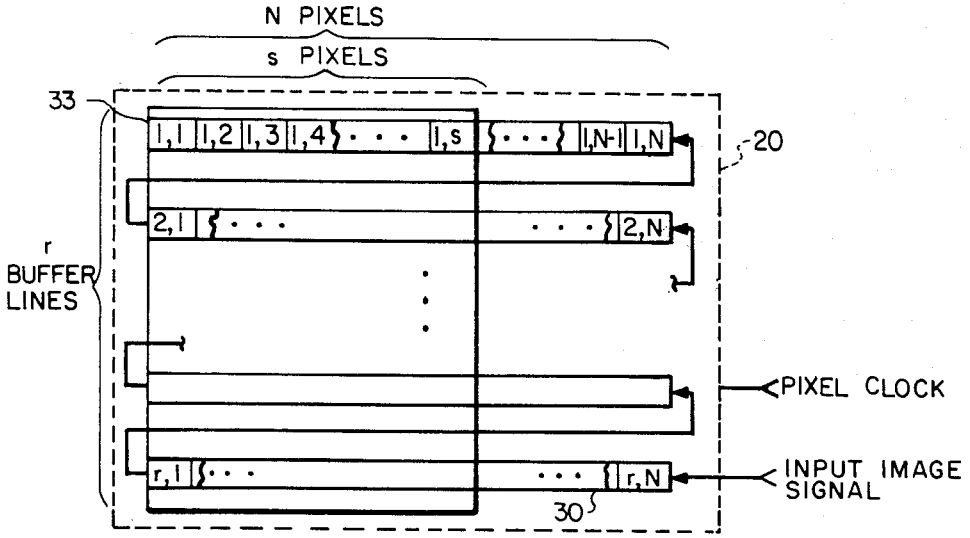
FIG. 3 is a partial schematic diagram illustrating the image buffer and subimage frame of the two-dimensional optical correlator illustrated in FIG. 2.

The arrangement of the image buffer 20 is illustrated in greater detail in FIG. 3. The buffer 20 includes r conventional analog delay lines, each comprising a linear CCD array having N serially-connected cells. Although not shown in FIG. 3, each storage buffer line is conventionally clocked by the pixel clock so that analog signals are shifted in a conventional manner from one end to the other of each buffer line at the pixel clock rate. As is known, if the input image signal is fed into one end of the buffer line 30 it is sampled once each pixel clock period. At the end of a line at the input image signal, N pixels will have been sampled and shifted into the buffer line 30. Each of the other r buffer lines operates identically.

The buffer lines of the buffer 20 are connected as shown in FIG. 3 so that as one buffer line is filled, its contents are entered into the entry port of the next buffer line above it. Thus, when the first r rows of the input image signal are entered into the buffer 20, it will be filled, the buffer line 31 holding the first horizontal line of the image and the buffer line 30, the rth image line.

It should be evident that the buffer 20 includes an $r \times N$ segment of the raster pattern in which the input image is displayed. As shown in FIG. 3, the buffer 20 also includes a smaller $r \times s$ segment that corresponds, in size, to the size of the subimages that are compared with the reference image. This segment constitutes a subimage frame 33.

Figure 4:
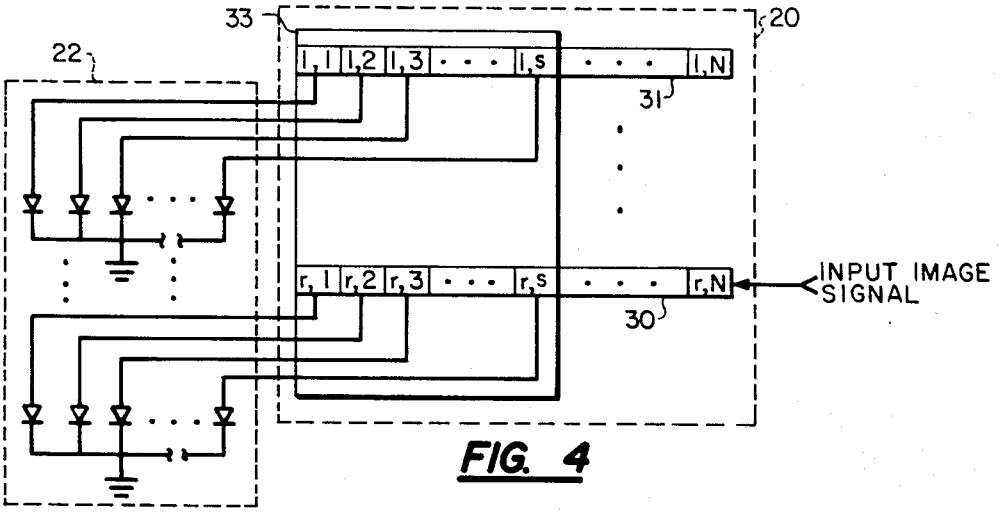
FIG. 4 is a partial schematic diagram illustrating how the subimage frame of FIG. 3 is connected to an array of light-emitting-diodes for generation of an optical signal corresponding to a subimage stored in the subimage frame.

FIG. 4 illustrates the interconnection between the image buffer 20 and the LED array 22. As shown, the LED array 22 includes r rows of LED's, each row including s LED's. Thus, the LED array 22 corresponds spatially with the format and size of the subimages to be compared with the reference image.

Each of the r rows of LED's in the array 22 is connected to a corresponding one of the r buffer lines in the subimage frame 33, with each LED of each row connected to a corresponding one of the first s cells in the buffer line. Each LED is connected to its respective buffer line cell in a conventional manner so that the LED emits light directly proportional to the magnitude of the pixel charge contained in the cell. Thus, the LED generates a light output that is equivalent in intensity to the magnitude of the pixel contained in the storage cell to which the LED is connected. It should be evident, also, that the array of LED's generates an array of optical pixels that together form an optical representation of the subimage stored in the $r \times s$ subimage frame.

Figure 5:
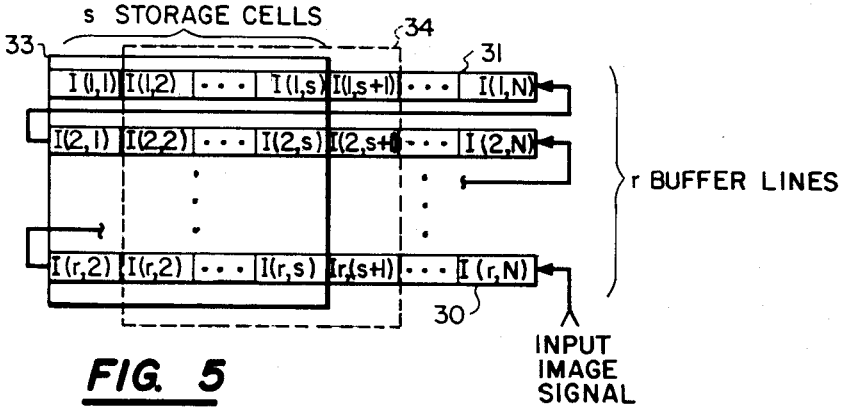
FIG. 5 illustrates the location of a representative subimage stored in the image buffer.
Figure 6:
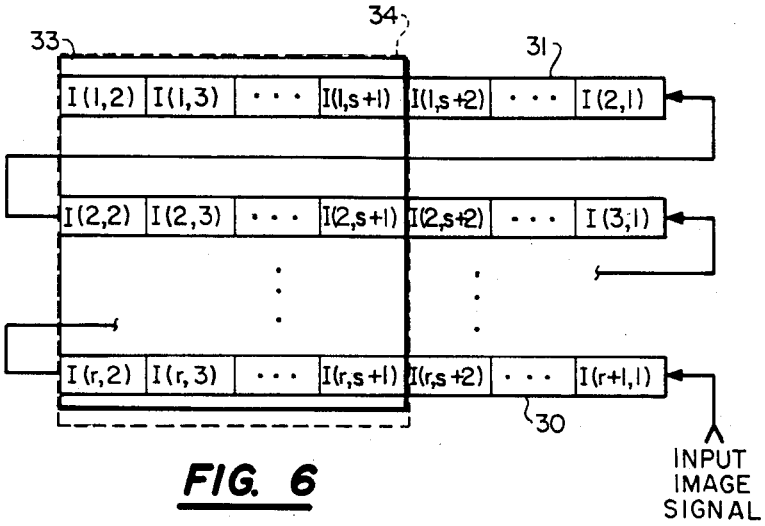
FIG. 6 is an illustration of how the subimage of FIG. 5 shifts through a distance of one column in the image buffer.

The serial shifting of a subimage through the buffer 20 is represented by FIGS. 5 and 6. In FIG. 5, the r buffer lines of the image buffer 20 are illustrated. The array including the first s storage cells of the r buffer lines that form $r \times s$ subimage frame 33. The subimage frame forms an unvarying, precisely located segment of the raster-scanned format segment through which all subimages of the input image signal are shifted. In FIG. 5, the first r rows of the input image signal have been entered into the buffer 20. The first complete subimage, including the first s pixels in each of the r rows, is held for 1 pixel clock period in the subimage frame 33. The next subimage to follow the first subimage into the subimage frame is represented by the dashed enclosure indicated by reference numeral 34.

At the next pixel clock period following the storage of the first subimage in the subimage frame, all of the pixels in the buffer 20 are conventionally shifted and the subimage 34 is stored for 1 pixel clock period in the subimage frame 33. This serial shifting causes each and every of the subimages to be stored within the subimage frame of the buffer 20 for one pixel clock period and then replaced at the next pixel clock transition by the next subimage.

The interconnection between the subimage frame 33 and the LED array 22 illustrated in FIG. 4 will cause the array 22 to respond to the succession of subimages stored in the subimage frame by producing a corresponding succession of optical image signals, each of which represents, in the optical energy domain, the subimage currently held in the subimage frame. It is these optical representations that form the succession of optical signals projected onto the reference image mask 24. The light transmitted through the mask for each subimage optical signal is focused by the lense 25 onto the detector 26 to produce the correlation signals on signal line 12.

Figure 7:
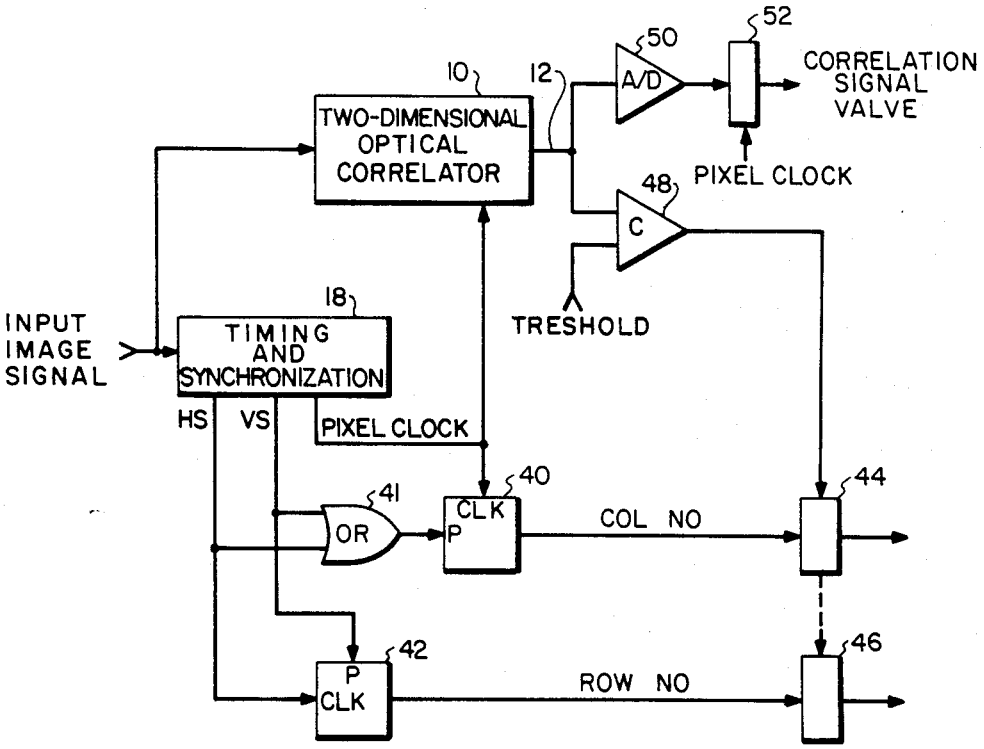
FIG. 7 is a partial schematic diagram illustrating how the location of a correlated subimage in the format of FIG. 1 is determined by the two-dimensional optical correlator of the invention.

When a subimage correlates with the reference image, the location of the subimage in the input image matrix illustrated in FIG. 1 can be found by the circuit of FIG. 7. As described above, the timing and synchronization circuit 18 strips the horizontal synchronization (HS) and vertical synchronization (VS) pulses from the composite video signal representing the input image. In addition, the timing and synchronization circuit 18 conventionally produces a pixel clock that oscillates at the frequency with which pixels occur in the lines of the raster-scanned format in which the input image is presented. The pixel clock is fed to the optical correlator 10 to clock the segment buffer 20 and is also fed to clock a conventional N-state counter 40, preset to N-s, which counts up at the pixel clock rate until cleared and reset to N-s by either HS or VS acting through the OR gate 41. The instantaneous output of the counter 40 represents the column containing the point (p,q) of the subimage currently contained in the subimage frame 33.

A conventional M-state counter 42 is preset to M-r and clocked by the horizontal synchronization pulse HS. The counter 42 counts through M states from M-r until cleared and reset by the vertical synchronization pulse VS. The instantaneous output of the counter 42 represents the number of the row containing the point (p,q) of the subimage currently contained in the subimage frame 33. Both the column number (COL NO) and the row number (ROW NO) are fed to respective digital latches 44 and 46. Both of the latches 44 and 46 are enabled to latch in a respective column or row number when the magnitude of the correlating signal output on line 12 exceeds the magnitude of a threshold signal against which it is conventionally compared in a comparator (C) 48. The level of the threshold against which the correlating signal is compared can be determined by monitoring the output of the photodetector 28 when a succession of known subimages corresponding to the reference image are fed through the segment buffer 20. Since the subimages are preselected to correspond to the reference image of the mask 24, the voltage level output by the photodetector 28 will be at a level that indicates correlation. This level can be used to establish the level of the threshold for comparing the output of the photodetector 28 when an arbitrary input image signal is fed to the correlator 10.

Then, whenever the level of the correlating signal on line 12 exceeds the level of the threshold signal, the comparator 48 will change state and cause the present column and row numbers to be held in the latches 44 and 46, respectively. When this occurs, the location $(P_0,q_0)$ of the correlating subimage will correspond to the latched column and row numbers.

Also connected to the signal line 12 are a conventional analog to digital (A/D) converter 50 which converts the level of the correlating signal to a digital value that is provided to a conventional latching circuit 52. At each pixel clock, a digital signal representing the correlation signal value of the subimage currently held in the subimage frame can be obtained from the latching circuit 52 for standard processing.

It will be evident to those skilled in the art that the optical correlation of the invention also performs the well-known mathematical operation called the "dot product" between the reference image matrix [R(K,L)] and each subimage matrix [I(K+p,L+q)] of the input image. If the dot product is given by:

$$F(p,q) = \sum_{L=r}^{s-1} \sum_{K=o}^{r-1} R(K,L) \cdot I(K+p,L+q)$$

then it has a maximum at $(P_o,q_o)$, the location indicated by the correlation signal maximum.

Obviously, many modifications and variations of the described two-dimensional optical correlator will occur to the skilled practitioner. It is therefore to be understood that within the scope of the following claims, the invention taught above may be practiced otherwise than as specifically described.

We claim:

1. An apparatus for optically correlating two images, comprising:

means for providing an input signal corresponding to a two-dimensional input image capable of being displayed in a raster-scanned format;

an optically transmissive mask having a pattern of optical transmissivity corresponding to a two-dimensional reference image;

buffer means for storing and serially shifting said input signal;

a subimage frame in said buffer means corresponding to a predetermined raster segment in said raster-scanned format for storing successive portions of said input signal as said input signal is shifted by said buffer means, each of said portions corresponding to a respective subimage of said input image;

optical means responsive to said successive portions stored in said subimage frame for projecting on said mask a succession of optical signals, each representing a respective subimage of said input image; and optical detection means for receiving light transmitted through said mask by the projection of said succession of optical signals, and for producing, based upon light transmitted by the projection of an optical signal, a correlation signal representative of the degree of correlation between said reference image and the subimage represented by said optical signal.

2. The apparatus of claim 1 wherein said buffer means includes a set of storage cells arranged to store an M×N array of pixel signals and connected to serially shift said M×N array of pixel signals in said raster-scanned format.

3. The apparatus of claim 2 wherein said subimage frame includes a respective subset of said storage cells arranged to store an r×s array of pixel signals at a location in said M×N array of pixel signals corresponding to said raster segment, and wherein $r+p<M+1$, $s+q<N+1$, and (p,q) is a fixed point in said M×N array.

4. The apparatus of claim 3 wherein said optical means includes an r×s array of photoemitters, each connected to a corresponding one of said storage cells of said respective subset.

5. The apparatus of claim 1 wherein said optical means includes an r×s array of photoemitters.

6. The apparatus of claim 1 wherein said pattern of optical transmissivity includes a plurality of transmissivity elements in an r×s array, said input image includes pixels forming an M×N array, and said subimage frame stores successive r×s arrays of said input image pixels, and wherein $r+p<M+1$, $s+q<N+1$, and (p,q) is a fixed point in said M×N array.

7. The apparatus of claim 6 wherein said optical means includes an r×s array of individual optical emitters.

8. The apparatus of claim 1 further including a lense means between said optical means and said optical detection means for focussing said transmitted light onto said optical detection means.

9. The apparatus of claim 8 wherein said optical detection means includes a photodiode.

10. A method for optically correlating a pair of images, comprising the steps of:

storing an input signal corresponding to a two-dimensional image having a raster-scanned format in an image buffer having a subimage frame corresponding to a predetermined raster segment of said raster-scanned format;

shifting said stored input signal through said subimage frame to successively store successive segments of said image in said subimage frame;

producing, in response to said successively-stored segments, a succession of optical signals, each corresponding to a respective one of said segments;

projecting said succession of optical signals through an optical mask having a transmissivity pattern corresponding to a reference image;

detecting the total amount of light transmitted through said mask as a result of the projection of each of said optical signals; and providing a correlating indication when said total amount of light exceeds a predetermined correlation threshold level.

11. An electro-optical apparatus for determining the location of a reference image including an r×s array of pixels within a larger image including an M×N array of pixels, comprising:

an image signal means for providing, in a serial sequence, an input image including an M×N array of image pixels;

an optical mask having transmissivity information representative of a reference image that is smaller than said input image;

two-dimensional storage means, including an array of pixel storage cells, for receiving said serial sequence and shifting said sequence serially through an $r \times s$ subimage array of said cells in which $r < M$ and $s < N$;

an $r \times s$ array of optically-emissive elements, each responsive to a corresponding one of said subimage array cells, for projecting optical energy corresponding to pixels stored in said subimage array onto said mask;

photodetection means for collecting optical energy projected through said mask by said optically-emissive elements and providing a level signal representative of the level of said collected optical energy; and circuit means responsive to said level signal for comparing said input level signal against a predetermined correlation threshold signal level and for, based upon said comparing, providing an indication of a point $(p_0,q_0)$ in said $M \times N$ array defining the location of a portion of said input image which correlates with said reference image.

* * * * *